United States Patent [19]

Meade

[11] 4,054,101

[45] Oct. 18, 1977

[54] STEERING VANE

[76] Inventor: James M. Meade, 76 N. Kessing St., Porterville, Calif. 93257

[21] Appl. No.: 660,442

[22] Filed: Feb. 23, 1976

[51] Int. Cl.[2] ..... B63H 25/52

[52] U.S. Cl. ..... 114/144 C

[58] Field of Search ..... 114/144 C, 144 R

[56] References Cited

U.S. PATENT DOCUMENTS

| | | | |
|---|---|---|---|
| 1,681,415 | 8/1928 | Lee | 114/144 C |
| 3,678,878 | 7/1972 | Ross-Clunis | 114/144 C |
| 3,906,881 | 9/1975 | Von Trepka | 114/144 C |
| 3,942,461 | 3/1976 | Smith | 114/144 C |

*Primary Examiner*—Trygve M. Blix
*Assistant Examiner*—Stuart M. Goldstein

[57] ABSTRACT

An apparatus for steering watercraft in response to changes of the wind. The craft is steered by the combination of a horizontal wind vane pivoted about an axis which is 30° to the horizontal, an auxiliary rudder, an extended trim tab, and a cable control system. The extended trim tab is coupled to the auxiliary rudder. Also, the vane is coupled to the extended trim tab by the cable control system such that movement of the vane results in movement of the trim tab. Since the trim tab is coupled to the auxiliary rudder, changes in the position of the trim tab result in changes in position of the auxiliary rudder thereby steering the craft.

1 Claim, 5 Drawing Figures

STEERING VANE

FIELD OF THE INVENTION

The apparatus relates to watercraft and more specifically to means for automatically steering watercraft in response to changes in the wind.

DESCRIPTION OF THE PRIOR ART

When sailing large watercraft, it is frequently necessary to have a means for automatically steering the watercraft. Accordingly, several means for automatically steering a watercraft in response to the wind have been developed.

The first of such means comprised a vertical wind vane and a complex control linkage connecting the vane to the watercraft's rudder. Therefore, movement of the vertical vane resulted in movement of the rudder thereby steering the craft. This means worked but had several shortcomings. The major shortcoming was that the craft zigzags as a result of applying the control forces to the craft's own rudder. To overcome this shortcoming, an auxiliary rudder was added to the craft. This auxiliary rudder was still connected to the vertical vane via a complex control linkage. This modification reduced the zigzag but still had several deficiencies. The major deficiency was that it required a strong wind to operate.

A horizontal vane was added in place of the vertical vane to overcome this deficiency. This resulted in an apparatus that operated in moderate wind but did not operate satisfactorily in light airs. Further, this apparatus still used a rather complex control linkage between the vane and the auxiliary rudder. Furthermore, in such steering vanes, the horizontal vane pivots about the horizontal axis and as a result causes too much correction and oversteer thereby causing zigzag.

Accordingly, it is a general object of the present invention to provide a wind responsive automatic steering apparatus for watercraft.

It is another object of the present invention to provide a wind responsive automatic steering apparatus which does not appreciably zigzag.

It is still another object of the present invention to provide a wind responsive automatic steering apparatus which operates in light air.

It is yet another object of the present invention to provide a wind responsive automatic steering apparatus which is independent of the watercraft's own rudder.

It is another object of the present invention to provide a wind responsive automatic steering apparatus which is relatively simple.

It is still another object of the present invention to provide a wind responsive automatic steering apparatus which is relatively reliable.

SUMMARY OF THE INVENTION

In keeping with the principles of the present invention, the above objects are accomplished with the unique combination of a horizontal wind vane pivoted about an axis which is 30° to the horizontal, an auxiliary rudder, an extended trim tab coupled to the auxiliary rudder, and a cable control system. The wind vane is coupled to the trim tab by the cable control system. Furthermore, the auxiliary rudder is rotatably coupled to the watercraft. Therefore, movement of the wind vane results in movement of the trim tab. Since the trim tab is coupled to the auxiliary rudder and the auxiliary rudder is rotatably coupled to the watercraft, changes in position of the trim tab result in changes in position of the auxiliary rudder thereby steering the watercraft in response to the wind.

BRIEF DESCRIPTION OF THE DRAWINGS

The above-mentioned and other features and objects of the present invention will become more apparent by reference to the following description taken in conjunction with the accompanying drawings wherein like reference numerals denote like elements, and in which.

DESCRIPTION OF THE PREFERRED EMBODIMENT

Figure 1:
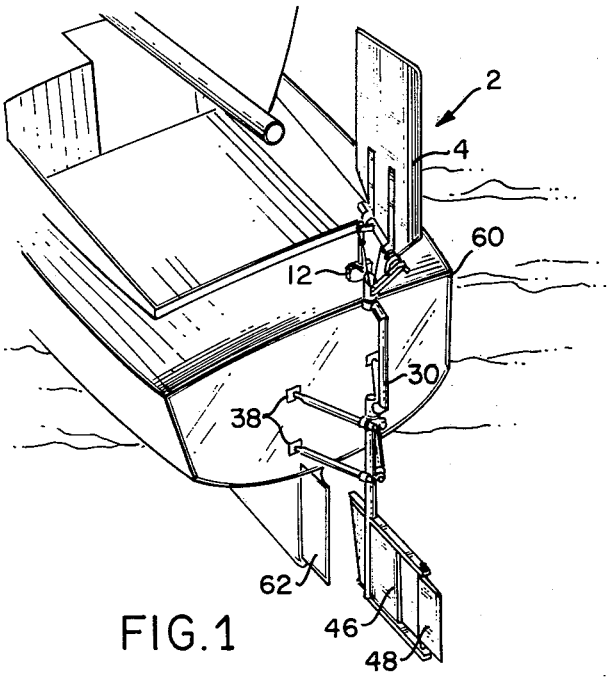
FIG. 1 is a simplified pictorial of a steering vane in accordance with the teachings of the present invention coupled to the transom of a watercraft.
Figure 2:
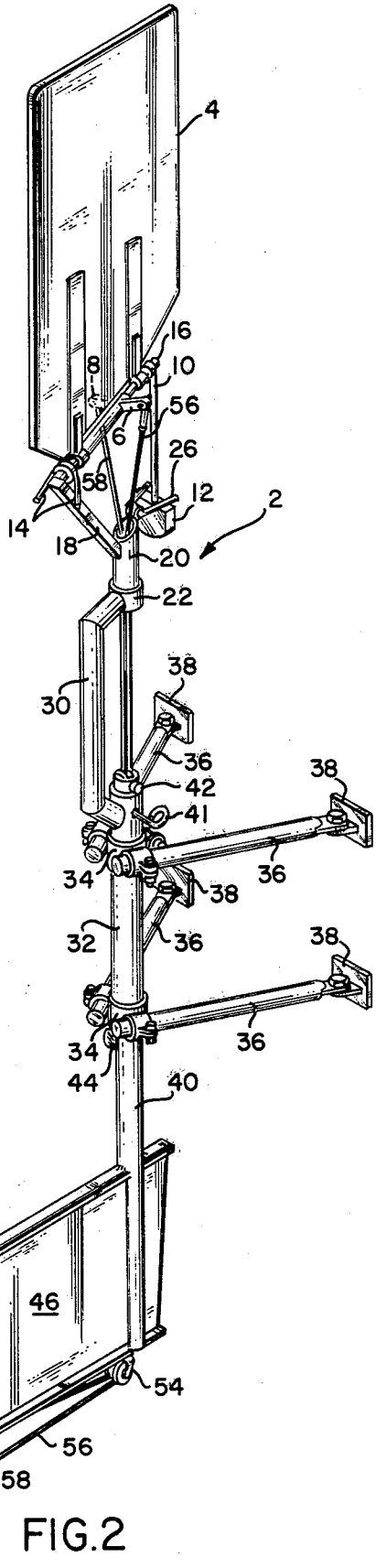
FIG. 2 is a detailed pictorial of a steering vane in accordance with the teachings of the present invention.

Referring more specifically to the drawings, FIG. 2 is a detailed pictorial of a steering vane in accordance with the teachings of the present invention. FIG. 1 and FIG. 2 are simplified pictorials of a steering vane in accordance with the teachings of the present invention and are included to facilitate an understanding of the nature and operation of the present invention.

Referring to the steering vane 2 of FIG. 2, the steering vane 2 includes a horizontal wind vane 4. Control arms 6 and 8 are coupled at right angles to vane 4. Rod 10 is coplanar with vane 4 and coupled at one end to the bottom edge of vane 4. Vane counter weight 12 is coupled to the other end of rod 10. Limit stops 14 are coupled to the bottom edge of vane 4. Furthermore, vane 4 is rotatably mounted on vane bearing 16.

Figure 4:
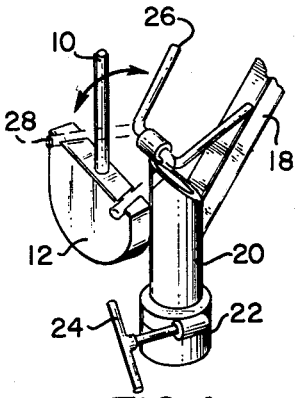
FIG. 4 is a pictorial of the vane locking mechanism of the steering vane of FIG. 2.

In addition, vane bearing 16 is connected at one end to one end of vane bearing support 18 and forms an angle of 30° to the horizontal. The other end of support 18 is connected to upper vane support 20. Upper vane support 20 rotatably fits inside of vane position clamp 22. Clamp 22 is secured by locking handle 24 shown in FIG. 4. Vane lock 26 is rotatably mounted on support 20 and engages with locking notches 28 in counter weight 12 when counter weight 12 is locked in the neutral position as shown in FIG. 4.

One end of support extension 30 is connected to vane position clamp 22. The other end of support extension 30 is connected to auxiliary rudder post support 32. Adjustable arms clamp 34 are connected to post support 32. Arms 36 are coupled at one end to arms clamp 34. The other end of arms 36 is coupled to mounting plates 38.

Figure 5:
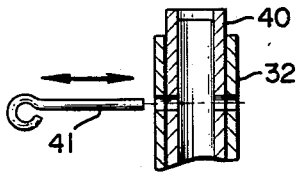
FIG. 5 is a partial cross-section of the means for locking the rudder of the steering vane of FIG. 2.

Auxiliary rudder post 40 rotatably fits within and extends through post support 32. Thrust bearing 42 is connected to the end of post 40 which extends through post support 32 and rides on the top edge of post support 32 thereby rotatably supporting post 40. Rudder post stop 44 is connected to post 40. Locking pin 41 extends through both post support 32 and rudder post 40 as shown in FIG. 5.

Auxiliary rudder 46 is connected to auxiliary rudder post 40. Extended trim tab 48 is rotatably coupled to rudder 46. Bell cranks 40 and 42 are coupled at right angles to trim tab 48. Rollers 54 are coupled to post 40. Arm 6, coupled to vane 4, is coupled to one end of control cable 56. Arm 8 is coupled to one end of control cable 58. Cables 56 and 58 pass through vane support 20, vane position clamp 22, and auxiliary rudder post 40. Cables 56 and 58 then ride over rollers 54 and are coupled respectively to bell cranks 52 and 50.

In practice, vane 4 can be made from either metal or epoxy impregnated fiberglass. Also, the rudder 46 and extended trim tab 48 can be made from a material which has substantially the same or less than the specific gravity of water to reduce the load on bearing 42 thereby increasing the reliability. Such materials include wood and lightweight plastics.

In operation, steering vane 2 is mounted on the transom of watercraft 60 by mounting plates 38, shown in FIG. 1. Then, locking pin 41 is removed from post support 32 thereby allowing rudder post 40 and auxiliary rudder 46 to rotate freely. Next, with wind vane 4 locked in the neutral position by lock 26, cables 56 and 58 are adjusted so that extended trim tab 48 is also in the neutral position when wind vane 4 is in the neutral position.

Watercraft 60 is set on a heading by rudder 62, shown in FIG. 1. After the new heading is achieved and rudder 62 is in the neutral position, wind vane 4 is unlocked by lifting vane lock 26 from locking notches 28 thereby allowing free movement of wind vane 4. Locking handle 24 is then turned thereby loosening vane position clamp 22 on upper vane support 20. Upper vane support 20 is then rotated to a position wherein wind vane 4 is in the neutral position with the wind blowing and watercraft 60 proceeding on its heading.

Figure 3:
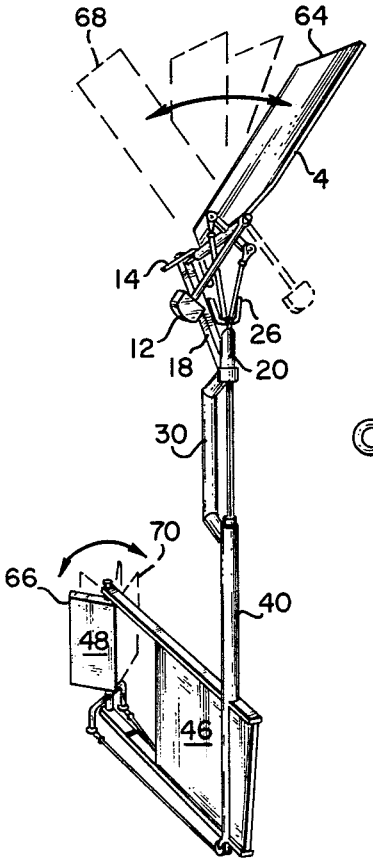
FIG. 3 is a simplified pictorial of the steering vane of FIG. 2 with the vane and trim tab in various relative positions.

If the wind direction changes, the force on one side of wind vane 4 will increase thereby causing wind vane 4 to rotate about bearing 16. Since wind vane 4 is coupled to extended trim tab 48 via arms 6 and 8, cables 56 and 58, and bell cranks 50 and 52, extended trim tab 4 also rotates as wind vane 4 rotates as shown in FIG. 3. Referring to FIG. 3, when wind vane 4 moves to position 64, trim tab 48 moves to position 66 and conversely the same is true of positions 68 and 70.

When trim tab 48 is rotated from the neutral position, the force of the water flowing over extended trim tab 48 causes extended trim tab 48 together with auxiliary rudder 46 to rotate thereby causing watercraft 60 to turn. When watercraft 60 has turned sufficiently that wind vane 4 is in the same position relative to the wind as before the wind change, wind vane 4 will return to the neutral position thereby causing trim tab 48 and auxiliary rudder 46 to return to the neutral position. Since vane 4 pivots about an axis which is substantially 30° to the horizontal, over steer and correction are substantially avoided thereby substantially eliminating zigzag.

Additional features of the present invention are easily ascertainable and are pointed out in the following discussion. Since trim tab 48 is coupled to wind vane 4 by flexible cables 56 and 58 which pass through the center of the steering vane structure and auxiliary rudder 46 is rotatably mounted to watercraft 60, auxiliary rudder 46 is completely independent of the watercrafts rudder 62 and can rotate a full 360 degrees. Also, if one desires to race his watercraft, wind vane 2 can be easily made inoperative by disconnecting cables 56 and 58, removing thrust bearing 42, and pulling rudder post 40 from post support 32 thereby completely removing auxiliary rudder 46. In addition, watercraft 60 can be steered by moving counter weight 12 manually. Furthermore, auxiliary rudder 46 together with trim tab 48 can be locked in any position by simply the addition of the proper holes in rudder post 40 through which locking pin 41 can be inserted. Also, limit stops 14 prevent overloading of the watercraft's transom.

In all cases, it is understood that the above-described embodiment is merely illustrative of one of many possible embodiments which can represent application of the principles of the present invention. Numerous and varied other arrangements can be readily devised in accordance with these principles by those skilled in the art without departing from the spirit and scope of the invention.

What is claimed is:

1. A steering vane for a watercraft or the like comprising:

an auxiliary rudder suspended from a rudder post, said auxiliary rudder comprising:
- a rudder; and
- an extended trim tab, said trim tab being rotatably mounted behind said rudder;

a wind vane, said wind vane having a neutral position wherein said wind vane is substantially vertical;

a vane bearing for supporting said vane for pivoting about an axis which is substantially 30° to the horizontal;

a support extension said support extending between and supporting said vane and said rudder post, said vane bearing an said rudder post being supported respectively one above the other; and comprising:
- a hollow tube;
- a clamp at one end of said tube, said clamp for setting said wind vane in said neutral position when said watercraft is proceeding on a heading; and
- an auxiliary rudder post support, said rudder post being rotatably coupled to said rudder post support;

a counterweight coupled to said wind vane; and a vane lock rotatably coupled to said clamp and engaging with a pair of locking notches in said weight.

* * * * *